US009874057B2

(12) United States Patent
Huang

(10) Patent No.: US 9,874,057 B2
(45) Date of Patent: Jan. 23, 2018

(54) WINDOW BLIND DEVICE

(71) Applicant: TAICANG KINGFU PLASTIC MANUFACTURE CO., LTD., Taicang (CN)

(72) Inventor: Szu-Chang Huang, Changhua County (TW)

(73) Assignee: Taicang Kingfu Plastic Manufacture Co., Ltd., Jiangshu Province (CN)

( * ) Notice: Subject to any disclaimer, the term of this patent is extended or adjusted under 35 U.S.C. 154(b) by 0 days.

(21) Appl. No.: 15/141,202

(22) Filed: Apr. 28, 2016

(65) Prior Publication Data

US 2016/0340975 A1 Nov. 24, 2016

(30) Foreign Application Priority Data

May 19, 2015 (CN) ..... 2015 2 0320565 U

(51) Int. Cl.
*E06B 9/30* (2006.01)
*E06B 9/36* (2006.01)
*E06B 9/322* (2006.01)

(52) U.S. Cl.
CPC ..... *E06B 9/322* (2013.01); *E06B 2009/3222* (2013.01)

(58) Field of Classification Search
CPC ..... E06B 2009/3222; E06B 2009/3225
USPC ..... 160/170, 84.05
See application file for complete search history.

(56) References Cited

U.S. PATENT DOCUMENTS 5,170,830 A * 12/1992 Coslett ..... B60J 1/2091 160/192
6,012,506 A * 1/2000 Wang ..... E06B 9/30 160/170
6,024,154 A * 2/2000 Wang ..... E06B 9/322 160/168.1 R
6,056,036 A * 5/2000 Todd ..... E06B 9/262 160/84.01
6,289,965 B1 * 9/2001 Ruggles ..... E06B 9/60 160/170
6,575,223 B1 * 6/2003 Chung ..... E06B 9/32 160/170
6,761,203 B1 * 7/2004 Huang ..... E06B 9/322 160/170
7,093,644 B2 * 8/2006 Strand ..... E06B 9/322 160/170
7,406,995 B2 * 8/2008 Huang ..... E06B 9/322 160/170
2006/0278348 A1 12/2006 Huang
(Continued)

FOREIGN PATENT DOCUMENTS

CN 2881049 Y 3/2007
EP 0796994 A2 9/1997

*Primary Examiner* — Katherine S Mitchell
*Assistant Examiner* — Jeremy C Ramsey
(74) *Attorney, Agent, or Firm* — LeClairRyan

(57) ABSTRACT

A window blind device includes a headrail, a bottomrail, a window shade, first and second control wheels, first and second cord spools, first and second cords, and a coil spring. The coil spring has a looped end portion sleeved on a first wheel hub of the first control wheel, and a spring body wound on the first wheel hub and extending from the looped end portion to terminate at a leading spring end which is connected to a second wheel hub of the second control wheel.

7 Claims, 16 Drawing Sheets

(56) References Cited

U.S. PATENT DOCUMENTS

| | | | | |
|---|---|---|---|---|
| 2007/0151675 | A1* | 7/2007 | Nien | E06B 9/30 160/84.05 |
| 2007/0151676 | A1* | 7/2007 | Lin | E06B 9/262 160/170 |
| 2007/0227677 | A1* | 10/2007 | Yu | E06B 9/322 160/170 |
| 2014/0083631 | A1 | 3/2014 | Huang | |
| 2014/0291431 | A1 | 10/2014 | Huang | |
| 2015/0136892 | A1* | 5/2015 | Hung | E06B 9/322 242/397.5 |
| 2015/0275572 | A1 | 10/2015 | Huang | |

* cited by examiner

WINDOW BLIND DEVICE

CROSS-REFERENCE TO RELATED APPLICATION

This application claims priority from Chinese application no. 201520320565.8, filed on May 19, 2015.

FIELD

The disclosure relates to a window blind device, more particularly to a coil spring of a window blind device.

BACKGROUND

U.S. Pat. No. 6,289,965 B1 discloses a conventional window blind which includes a head rail, a base rail, an expandable window covering between the head rail and the base rail, and a spring motor. The spring motor includes a frame, a drive drum, an idler gear, a take-up drum, a coil spring. The drive drum is rotatably mounted to the frame. The idler gear is rotatably mounted to the frame and is operably connected to the drive drum. Rotation of the idler gear causes rotation of the drive drum. The take-up drum is rotatably mounted on and concentric with the idler gear. The idler gear is rotatable independently of the take-up drum. The coil spring is interconnected between the take-up drum and the drive drum. The coil spring is biased into a wound orientation on the take-up drum. When a user pulls the base rail downwardly to displace the base rail such that the coil spring is unwound from the take-up drum and is wound on the drive drum, a friction force is generated between the coil spring and the take-up drum. Since the coil spring is normally made of metal, the take-up drum is likely to become worn due to friction with the coil spring. Thus, the conventional window blind may have a relatively short service life.

SUMMARY

Therefore, an object of the disclosure is to provide a window blind device with a longer service life.

According to the disclosure, a window blind device includes a headrail, a bottomrail, a window shade, first and second control wheels, and a coil spring. The headrail extends in a longitudinal direction. The bottomrail extends in the longitudinal direction to terminate at left and right ends, and are movable relative to the headrail in an upright direction between an uppermost position and a lowermost position. The window shade has an upper end connected to the headrail, and a lower end connected to the bottomrail so as to be moved therewith. The first control wheel includes a first wheel hub mounted rotatably on one of the headrail and the bottomrail about a first wheel axis. The second control wheel includes a second wheel hub mounted rotatably on said one of the headrail and the bottomrail about a second wheel axis parallel to the first wheel axis. The coil spring has a looped end portion sleeved on the first wheel hub, and a spring body wound on the first wheel hub and extending from the looped end portion to terminate at a leading spring end which is connected to the second wheel hub. The first and second control wheels are coupled to the other one of the headrail and the bottomrail, such that in synchrony with displacement of the bottomrail from the uppermost position to the lowermost position, the looped end portion and the first wheel hub are rotated relative to each other.

BRIEF DESCRIPTION OF THE DRAWINGS

Other features and advantages of the disclosure will become apparent in the following detailed description of the embodiments with reference to the accompanying drawings, in which.

DETAILED DESCRIPTION

Figure 1:
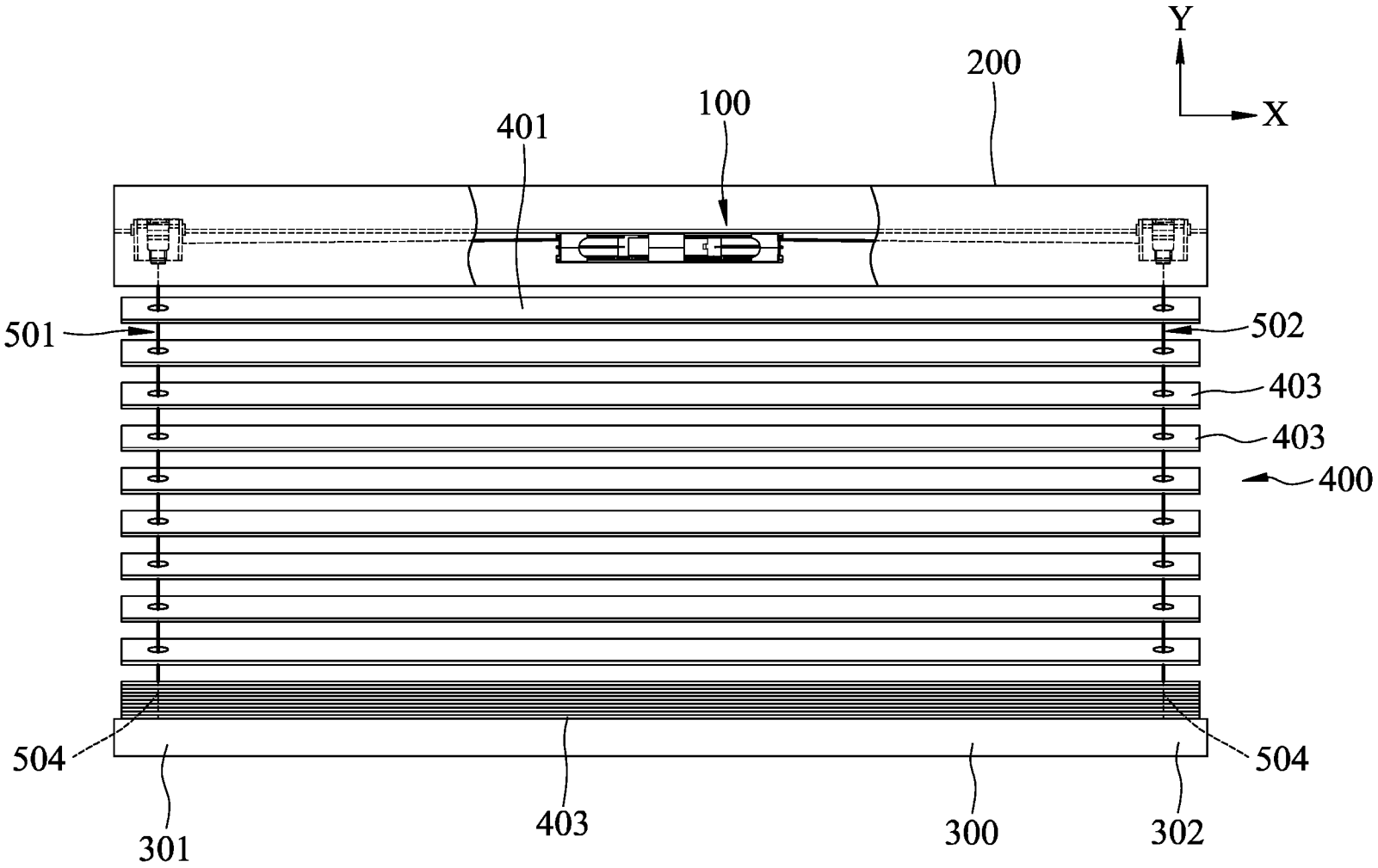
FIG. 1 is a perspective view of a window blind device according to a first embodiment of the disclosure.

Before the disclosure is described in greater detail, it should be noted that like elements are denoted by the same reference numerals throughout the disclosure.

With reference to FIG. 1, a window blind device according to a first embodiment of this disclosure includes a spring motor 100, a headrail 200, a bottomrail 300, and a window shade 400.

The headrail 200 extends in a longitudinal direction (X). The bottomrail 300 extends in the longitudinal direction (X) to terminate at left and right ends 301, 302, and is movable relative to the headrail 200 in an upright direction (Y) between an uppermost position and a lowermost position.

The window shade 400 has an upper end 401 connected to the headrail 200, and a lower end 402 connected to the bottomrail 300 so as to be moved therewith. In this embodiment, the window shade 400 includes a plurality of parallel slats 403 suspended between the headrail 200 and the bottomrail 300 in a conventional manner with the use of ladder cords (not shown).

Figure 2:
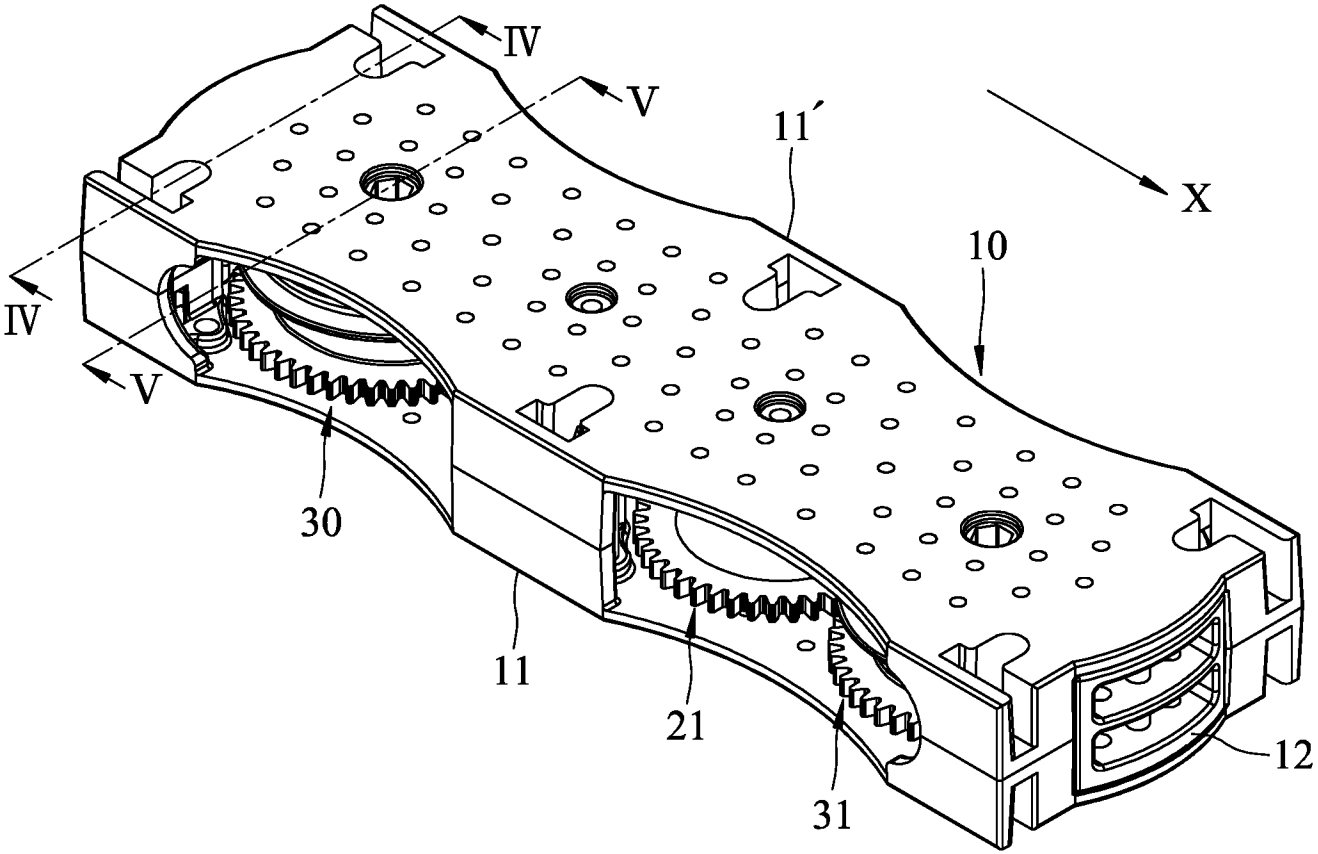
FIG. 2 is a perspective view illustrating a frame, control wheels, and cord spools of the window blind device.
Figure 3:
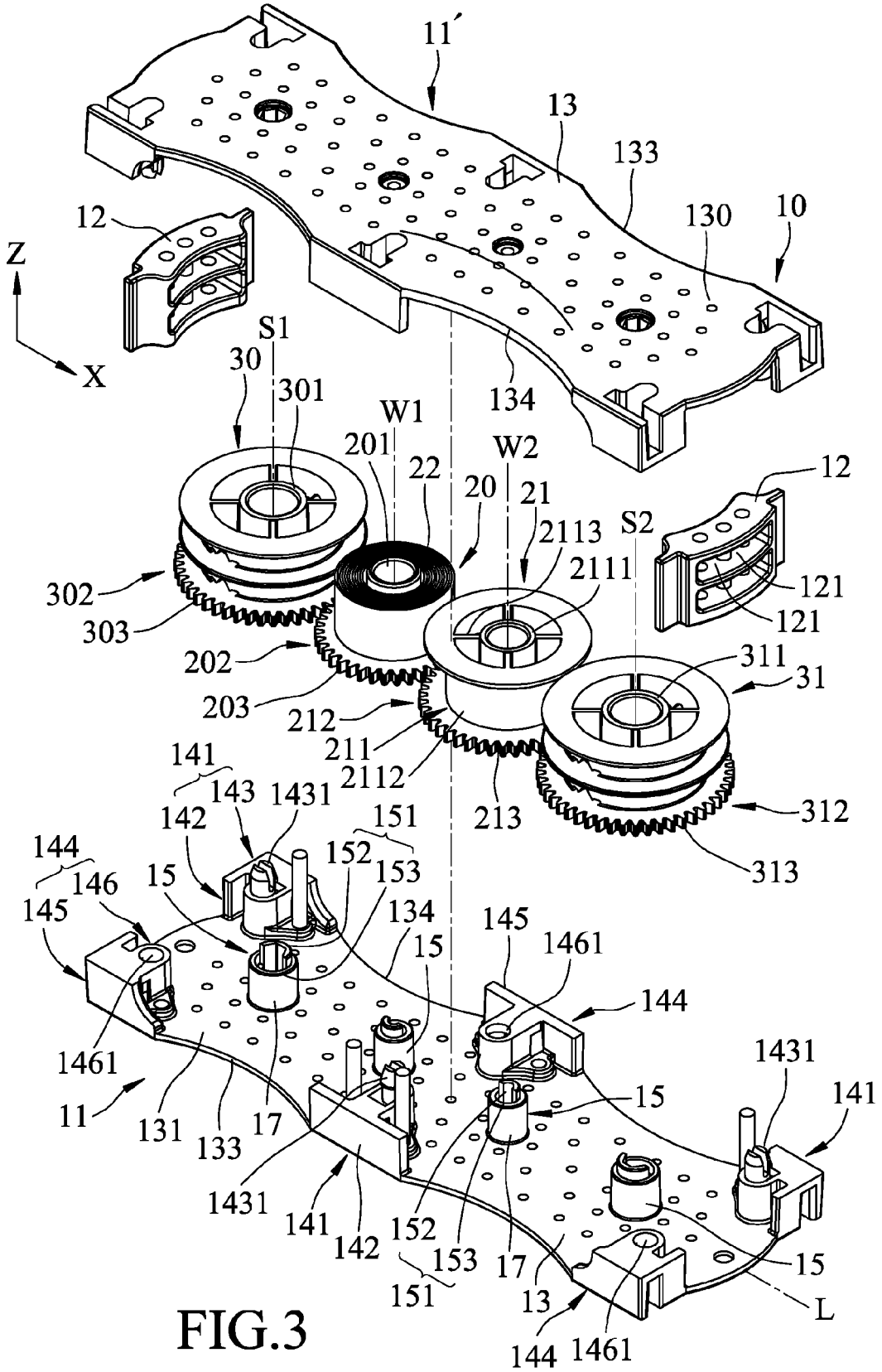
FIG. 3 is an exploded perspective view of FIG. 2.

As shown in FIGS. 1, 2 and 3, the spring motor 100 includes a frame 10, first and second control wheels 20, 21, a coil spring 22, first and second cord spools 30, 31, and first and second cords 501, 502.

Figure 4:
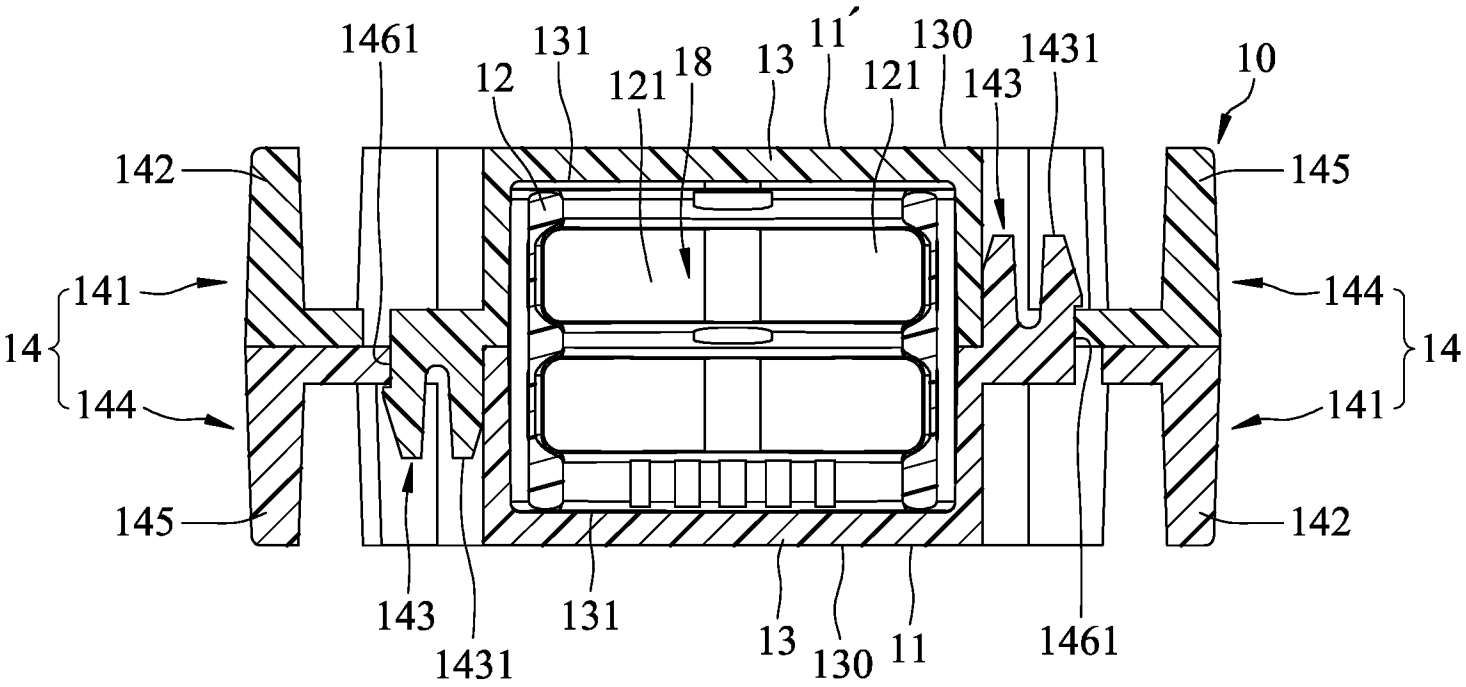
FIG. 4 is a cross-sectional view taken along line IV-IV of FIG. 2.

The frame 10 is disposed on the headrail 200, and has two frame halves 11, 11' which are brought into mating engagement with each other, and which define therebetween an accommodating space 18 (see FIG. 4). As best shown in FIG. 3, each of the frame halves 11, 11' includes a wall body 13, a plurality of shaft halves 15, and at least a pair of first and second spacer halves 141, 144.

Figure 6:
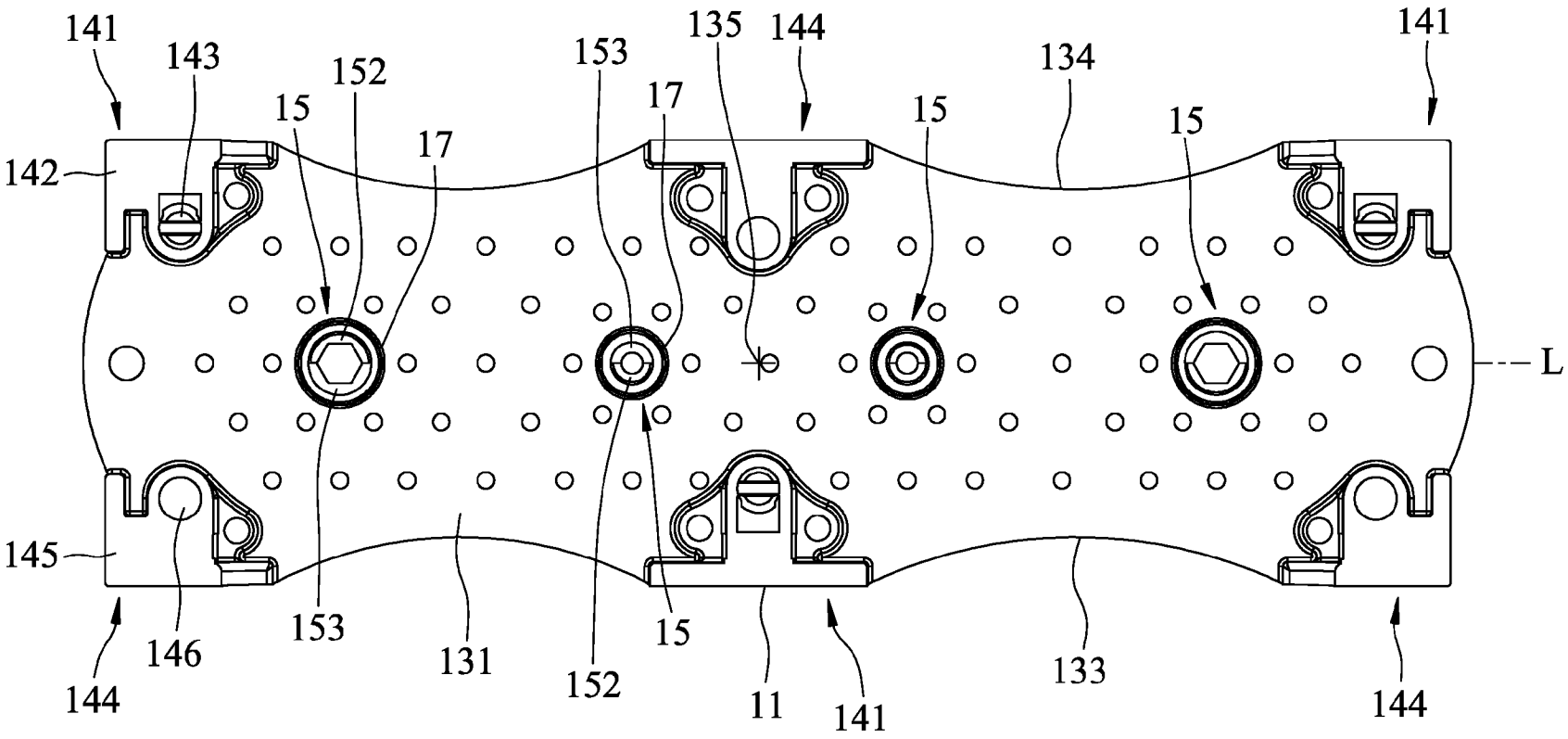
FIG. 6 is a top view of a frame half of the frame.

The wall body 13 is perforated, and has inner and outer major surfaces 131, 130, and first and second side edges 133, 134. The inner surface 131 has a geometric center 135 (see FIG. 6). The first and second side edges 133, 134 of the wall body 13 of one of the frame halves 11, 11' are respectively in alignment with the second and first side edges 134, 133 of the wall body 13 of the other one of the frame halves 11, 11' when the frame halves 11, 11' are brought into mating engagement with each other.

The shaft halves 15 are disposed on the inner major surface 131 of the wall body 13 of each of the frame halves 11, 11' to cooperatively define a symmetrical line (L) in the longitudinal direction (X). Each of the shaft halves 15 includes a stem segment 17 and a connecting segment 151 which has male and female connecting regions 152, 153 which are symmetrically arranged relative to the symmetrical line (L). The stem segment 17 extends from the inner major surface 131 in a direction (Z) transverse to the longitudinal direction (X). The connecting segment 151 extends from the stem segment 17 in the transverse direction (Z). In this embodiment, the transverse direction (Z) is parallel to the upright direction (Y), and the geometric center 135 is on the symmetrical line (L) (see FIG. 6).

Figure 5:
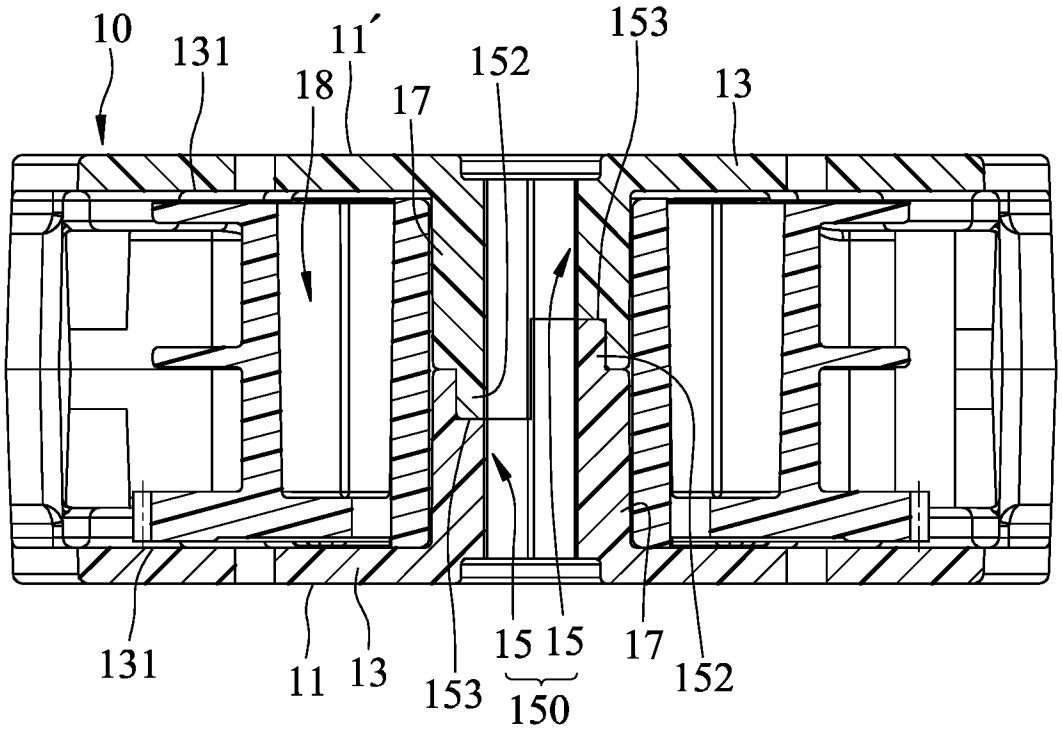
FIG. 5 is a cross-sectional view taken along line V-V of FIG. 2.

With reference to FIGS. 3 and 5 to 8, the male and female connecting regions 152, 153 of the connecting segment 151 of each of the shaft halves 15 of each of the frame halves 11, 11' are configured to matingly fit with the female and male connecting regions 153, 152 of a corresponding one of the shaft halves 15 of the other one of the frame halves 11, 11', respectively, such that the shaft halves 15 of the frame halves 11, 11' form a plurality of supporting shafts 150 (only one is shown in FIG. 5) when the frame halves 11, 11' are brought into mating engagement with each other. As shown in FIG. 5, the male connecting region 152 of one of the shaft halves 15 of each of the frame halves 11, 11' and the female connecting region 153 of the corresponding one of the shaft halves 15 of the other one of the frame halves 11, 11' are of a tenon-and-mortise configuration.

With reference to FIGS. 3, 4, and 6 to 8, in each of the frame halves 11, 11', the first and second spacer halves 141, 144 are arranged symmetrically on the inner major surface 131 of the wall body 13 relative to the symmetrical line (L), and are spaced apart from each other. The first spacer half 141 has a first base segment 142 disposed on the inner major surface 131 and a male segment 143 disposed on the first base segment 142. The second spacer half 144 has a second base segment 145 disposed on the inner major surface 131, and a female segment 146 disposed on the second base segment 145. The male and female segments 143, 146 of one of the frame halves 11, 11' are configured to be brought into press fit engagement with the female and male segments 146, 143 of the other one of the frame halves 11, 11', respectively, to form two spacers 14 when the frame halves 11, 11' are brought into mating engagement with each other (see FIG. 4). The male segment 143 of each of the frame halves 11, 11' has a frustoconical plug 1431 which is bifurcated to provide resiliency to the male segment 143. The female segment 146 of each of the frame halves 11, 11' has a mating cavity 1461. The mating cavity 1461 of one of the frame halves 11, 11' is configured to be in snap fit engagement with the frustoconical plug 1431 of the other one of the frame halves 11, 11'. In this embodiment, each of the frame halves 11, 11' includes a plurality of pairs of the first and second spacer halves 141, 144.

Figure 7:
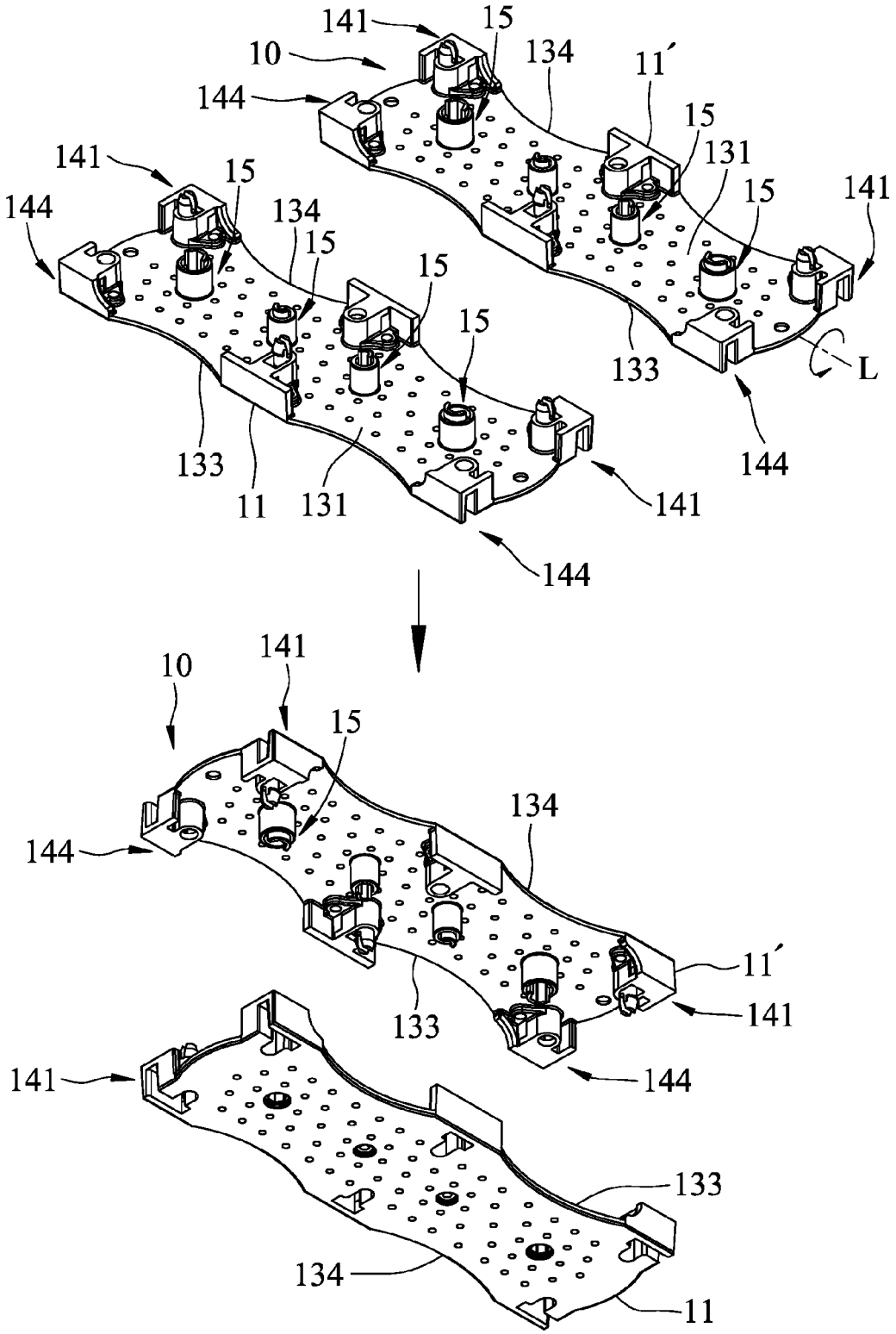
FIGS. 7 and 8 are exploded perspective views illustrating how two frame halves are assembled into a frame.
Figure 8:
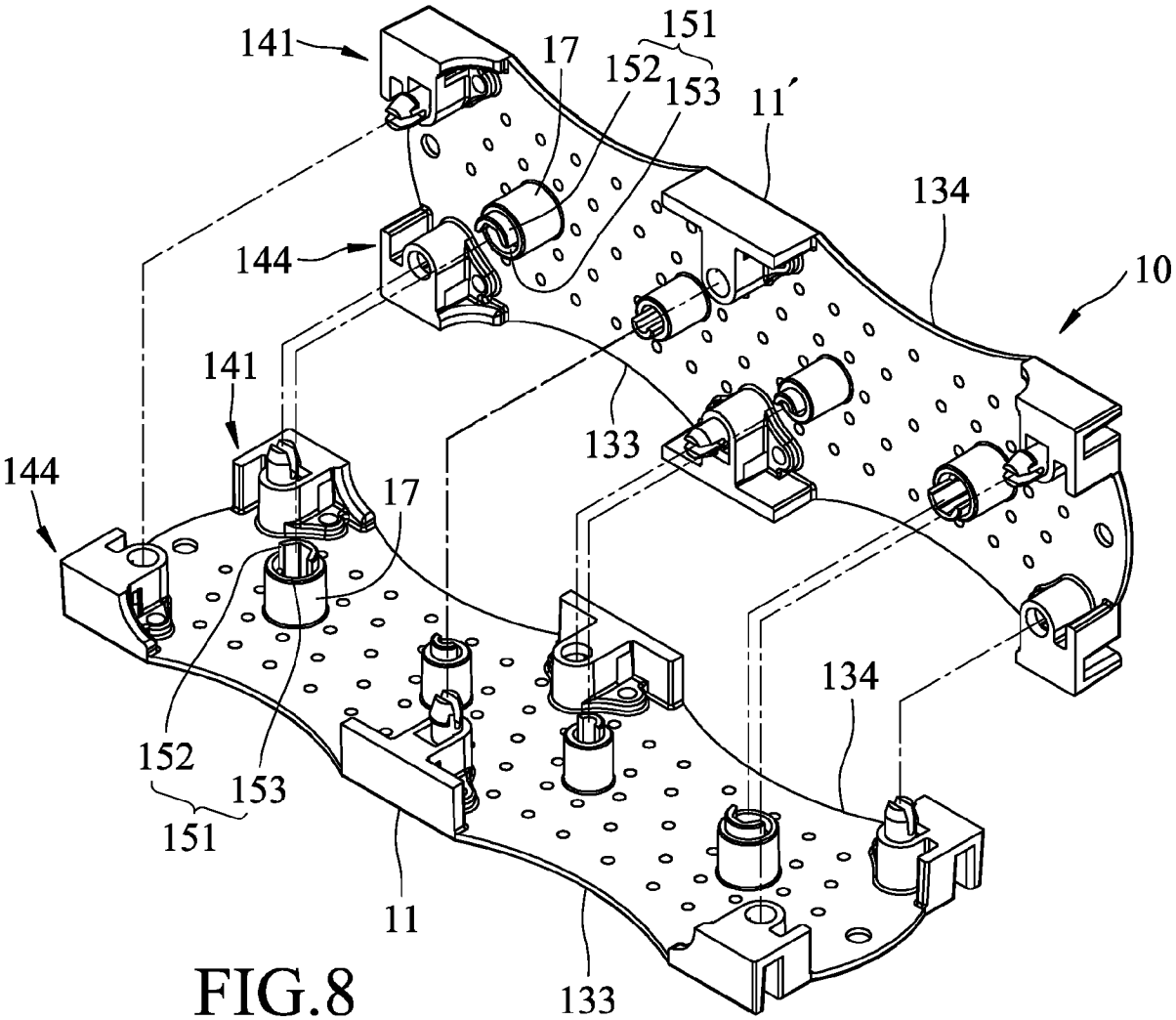

As shown in FIGS. 7 and 8, the frame halves 11, 11' are substantially the same. When assembling the frame halves 11, 11' into the frame 10, the inner major surfaces 131 of the frame halves 11, 11' are brought to face each other with the first and second side edges 133, 134 of the frame half 11 in alignment with the second and first side edges 134, 133 of the frame half 11', and the frame halves 11, 11' are then brought into mating engagement with each other.

As shown in FIGS. 2 and 3, the frame 10 further includes two side frame parts 12 which are disposed opposite to each other in the longitudinal direction (X), and which are sandwiched between the frame halves 11, 11' when the frame halves 11, 11' are brought into mating engagement with each other. Each of the side frame parts 12 has at least one through hole 121 to permit a corresponding one of the first and second cords 501, 502 to pass therethrough (see FIGS. 12 and 13). In this embodiment, each of the side frame parts 12 has a plurality of through holes 121.

Figure 10:
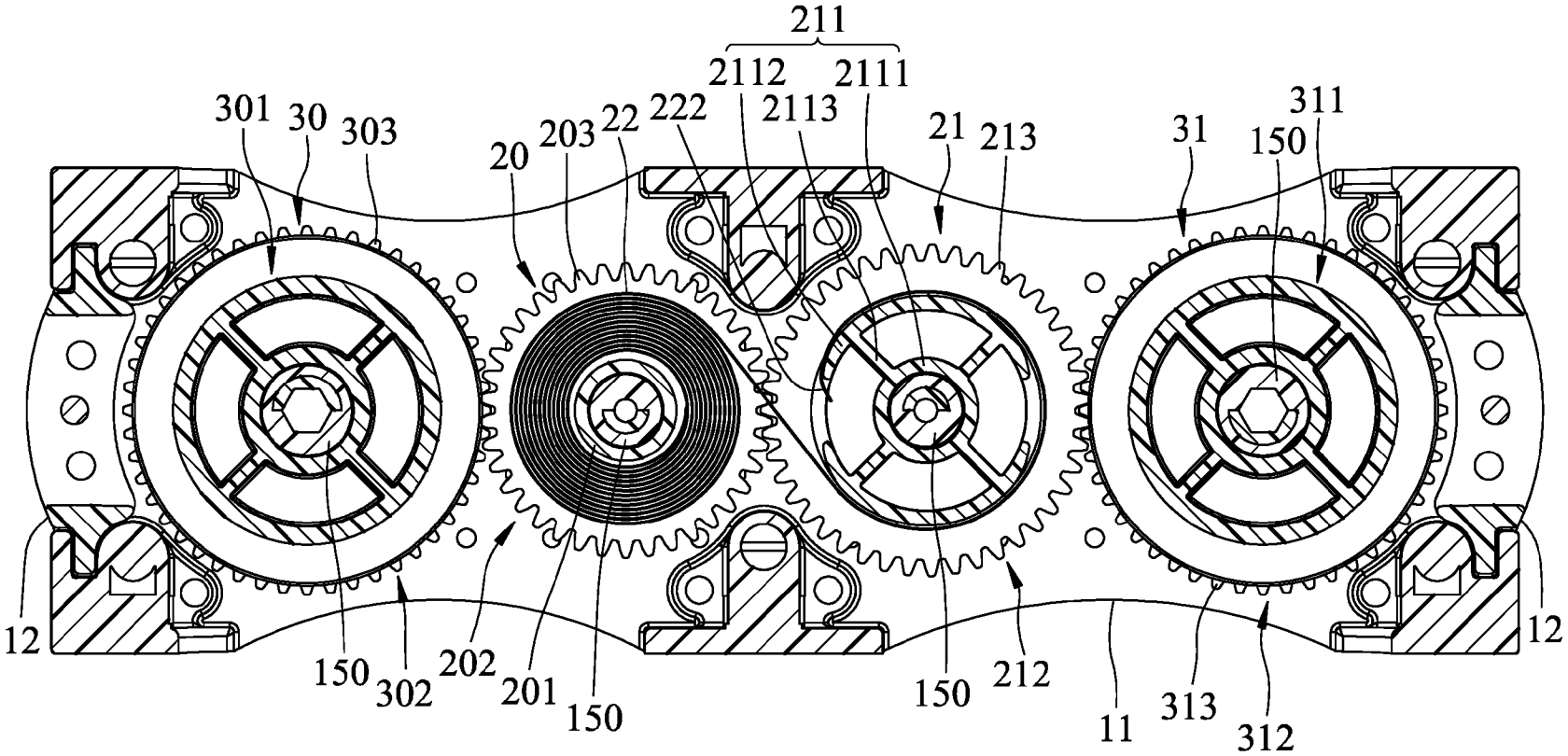
FIG. 10 is a cross-sectional view taken along line X-X of FIG. 9.

With reference to FIGS. 1 and 10, the first and second control wheels 20, 21 and the first and second cord spools 30, 31 are disposed in the accommodating space 18 to be rotatably mounted on the supporting shafts 150, respectively, and are coupled to the bottomrail 300 such that the bottomrail 300 is permitted to be displaced between the uppermost and lowermost positions.

As shown in FIGS. 3 and 10, the first control wheel 20 includes a first wheel hub 201 and a first wheel rim 202. The first wheel hub 201 is mounted rotatably on the headrail 200 by means of the frame 10 about a first wheel axis (W1). The first wheel rim 202 surrounds the first wheel axis (W1).

The second control wheel 21 includes a second wheel hub 211 and a second wheel rim 212. The second wheel hub 211 is mounted rotatably on the headrail 200 by means of the frame 10 about a second wheel axis (W2) parallel to the first wheel axis (W1). The second wheel rim 212 surrounds the second wheel axis (W2), and is configured to be in frictional engagement with the first wheel rim 202 so as to permit the first and second control wheels 20, 21 to rotate synchronously.

The first cord spool 30 includes a first spool hub 301 and a first spool rim 302. The first spool hub 301 is mounted rotatably on the headrail 200 by means of the frame 10 about a first spool axis (S1) parallel to the first wheel axis (W1). The first spool rim 302 surrounds the first spool axis (S1), and is configured to be in frictional engagement with the first wheel rim 202 so as to permit the first cord spool 30 and the first control wheel 20 to rotate synchronously.

The second cord spool 31 includes a second spool hub 311 and a second spool rim 312. The second spool hub 311 is mounted rotatably on the headrail 200 by means of the frame 10 about a second spool axis (S2) parallel to the first wheel axis (W1). The second spool rim 312 surrounds the second spool axis (S2), and is configured to be in frictional engagement with the second wheel rim 212 so as to permit the second cord spool 31 and the second control wheel 21 to rotate synchronously.

In this embodiment, the first control wheel 20 further includes a plurality of first wheel teeth 203 disposed on the first wheel rim 202 to surround the first wheel axis (W1). The second control wheel 21 further includes a plurality of second wheel teeth 213 which are disposed on the second wheel rim 212 to surround the second wheel axis (W2), and which are configured to mesh with the first wheel teeth 203 so as to permit the first and second control wheels 20, 21 to rotate synchronously. The first cord spool 30 further includes a plurality of first spool teeth 303 which are disposed on the first spool rim 302 to surround the first spool axis (S1), and which are configured to mesh with the first wheel teeth 203 so as to permit the first cord spool 30 and the first control wheel 20 to rotate synchronously. The second cord spool 31 further includes a plurality of second spool teeth 313 which are disposed on the second spool rim 312 to surround the second spool axis (S2), and which are configured to mesh with the second wheel teeth 213 so as to permit the second cord spool 31 and the second control wheel 21 to rotate synchronously.

In this embodiment, the frame 10 is made of polyoxymethylene (POM, polyacetal), and each of the first and second control wheels 20, 21 and the first and second cord spools 30, 31 is made of nylon 66 (PA 66, polyamide 6/6). Because the first and second control wheels 20, 21 and the first and second cord spools 30, 31 are made from a material different from that of the frame 10, noise produced during operation of the spring motor 100 can be reduced.

Figure 12:
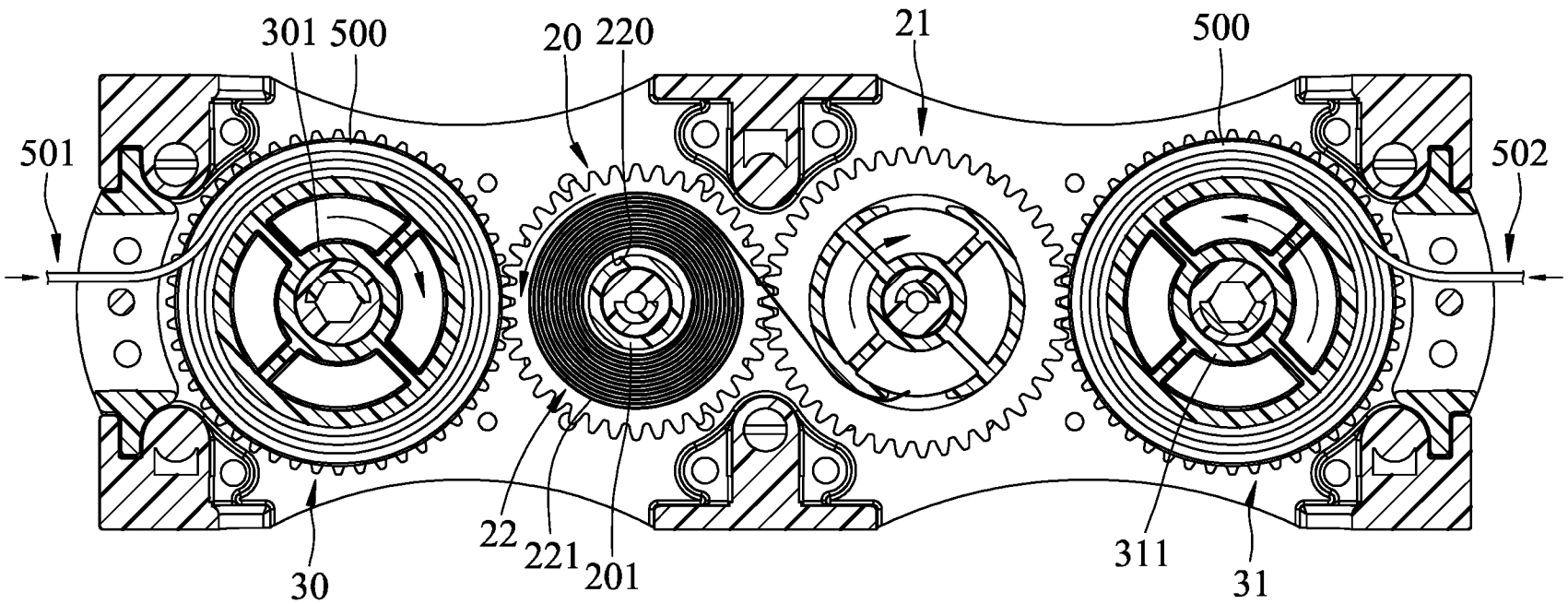
FIG. 12 is a cross-sectional view similar to FIG. 9, but illustrating a main cord segment of each of first and second cords in a drawn-in position.

With reference to FIGS. 1 and 12, each of the first and second cords 501, 502 has a main cord segment 500 which is wound on a corresponding one of the first and second spool hubs 301, 311, and which extends to terminate at a leading cord end 504 connected to a corresponding one of the left and right ends 301, 302 of the bottomrail 300 such that, in synchrony with the displacement of the bottomrail 300 from the uppermost position to the lowermost position, the main cord segment 500 is moved from a drawn-in position (FIG. 12) to a drawn-out position (FIG. 13) to drive the first and second cord spools 30, 31 to rotate.

Figure 9:
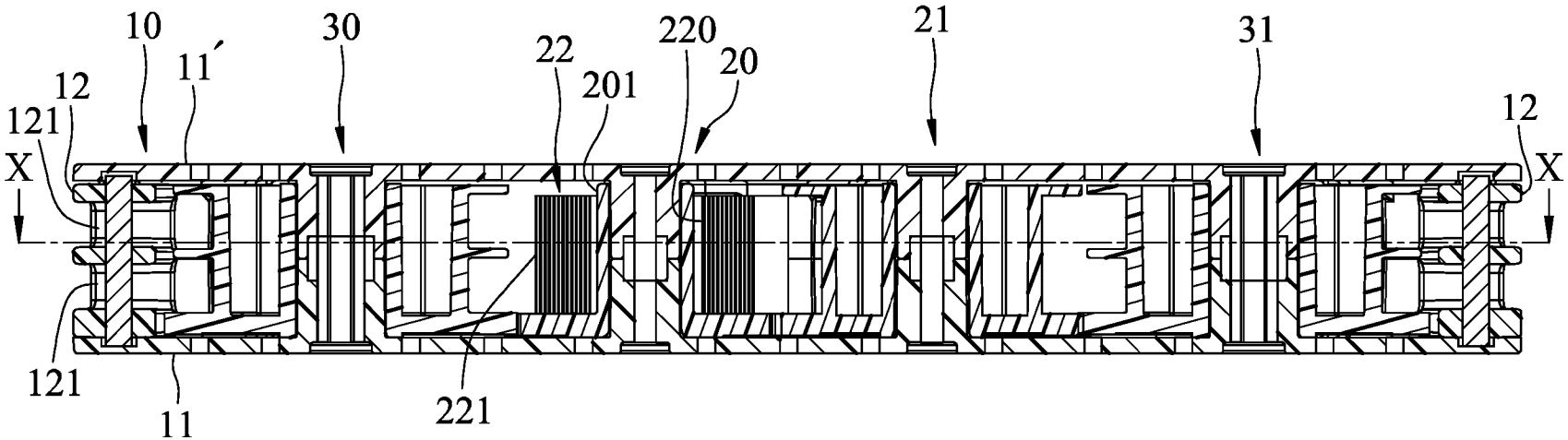
FIG. 9 is a transverse cross-sectional view of FIG. 2.
Figure 11:
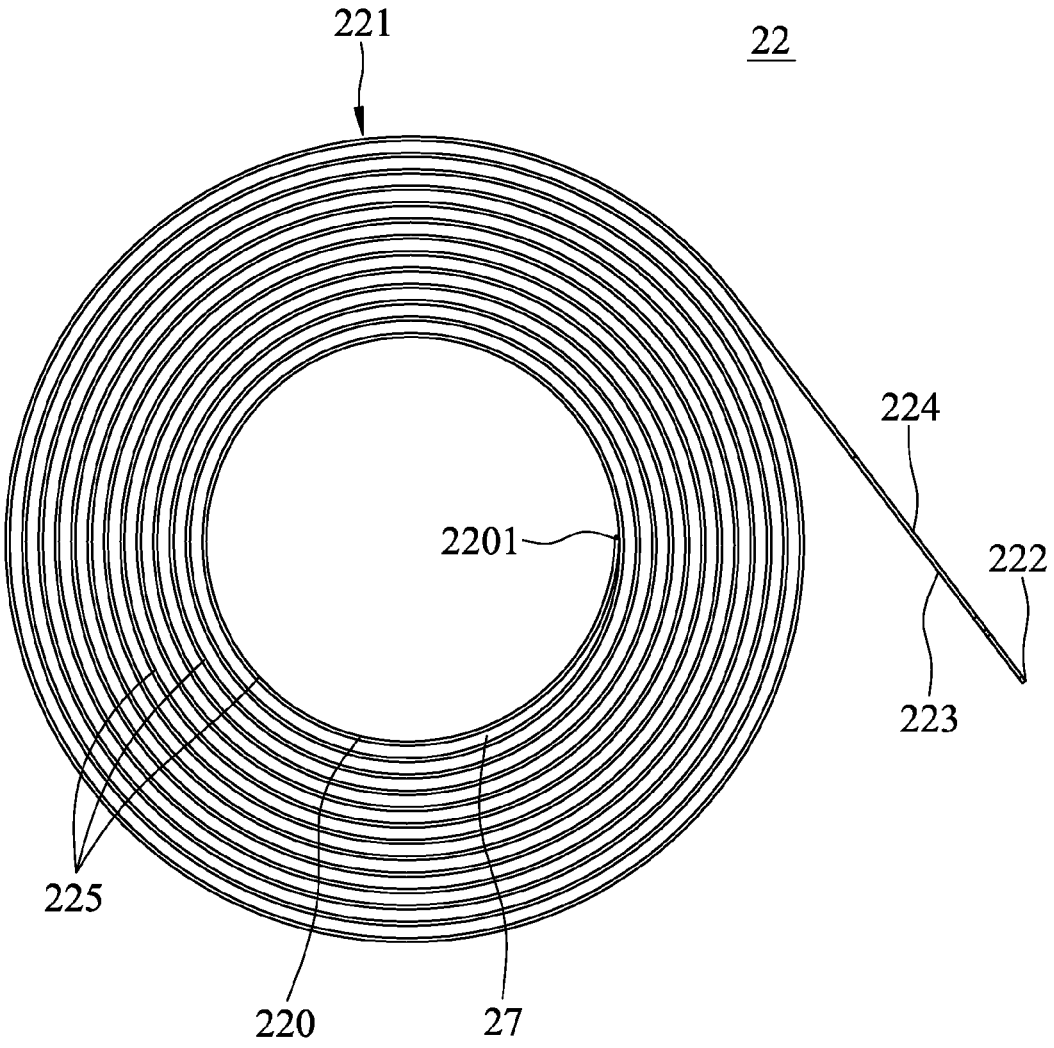
FIG. 11 is a top view of a coil spring used in the window blind device.

As shown in FIGS. 9, 10, and 11, the coil spring 22 has a looped end portion 220 sleeved on the first wheel hub 201, and a spring body 221 wound on the first wheel hub 201 and extending from the looped end portion 220 to terminate at a leading spring end 222 which is connected to the second wheel hub 211. In this embodiment, the coil spring 22 is a flat coil spring made of metal, and includes a plurality of coils 225, and the looped end portion 220 is formed by welding a terminal region 2201 of the spring body 221 (which is opposite to the leading spring end 222) onto the innermost coil 225. The looped end portion 220 is spaced apart from the spring body 221 by a non-equidistant spacing 27. The coil spring 22 has inner and outer coil surfaces 223, 224 opposite to each other. When the coil spring 22 is wound on the first wheel hub 201, the inner coil surface 223 faces the first wheel hub 201.

The second wheel hub 211 is configured to be of a larger dimension than the first wheel hub 201 such that, in response to the movement of the main cord segment 500 from the drawn-in position (FIG. 12) toward the drawn-out position (FIG. 13), the looped end portion 220 is rotated relative to the first wheel hub 201 to permit winding of the spring body 221 on the second wheel hub 211 to allow the spring body 221 to acquire a biasing force so as to cause the spring body 221 to wind back on the first wheel hub 201, thereby displacing the main cord segment 500 to the drawn-in position. When the spring body 221 is wound on the second wheel hub 211, the outer coil surface 224 faces the second wheel hub 221. As shown in FIG. 10, the second wheel hub 211 has an inner sub-hub 2111 of a dimension substantially the same as the first wheel hub 201, an outer sub-hub 2112 spaced apart from the inner sub-hub 2111 in radial directions, and a plurality of ribs 2113 interconnecting the inner sub-hub 2111 and the outer sub-hub 2112.

In this embodiment, because the frame halves 11, 11' are made using the same forming mold, and because they can be securely assembled without using fasteners (such as screws), the frame 10 can be produced at reduced cost. In addition, when the frame halves 11, 11' are brought into mating engagement with each other, the first and second control wheels 20, 21 and the first and second cord spools 30, 31 are supported between the frame halves 11, 11'. Thus, the spring motor 100 of the window blind device can be easily assembled.

Figure 13:
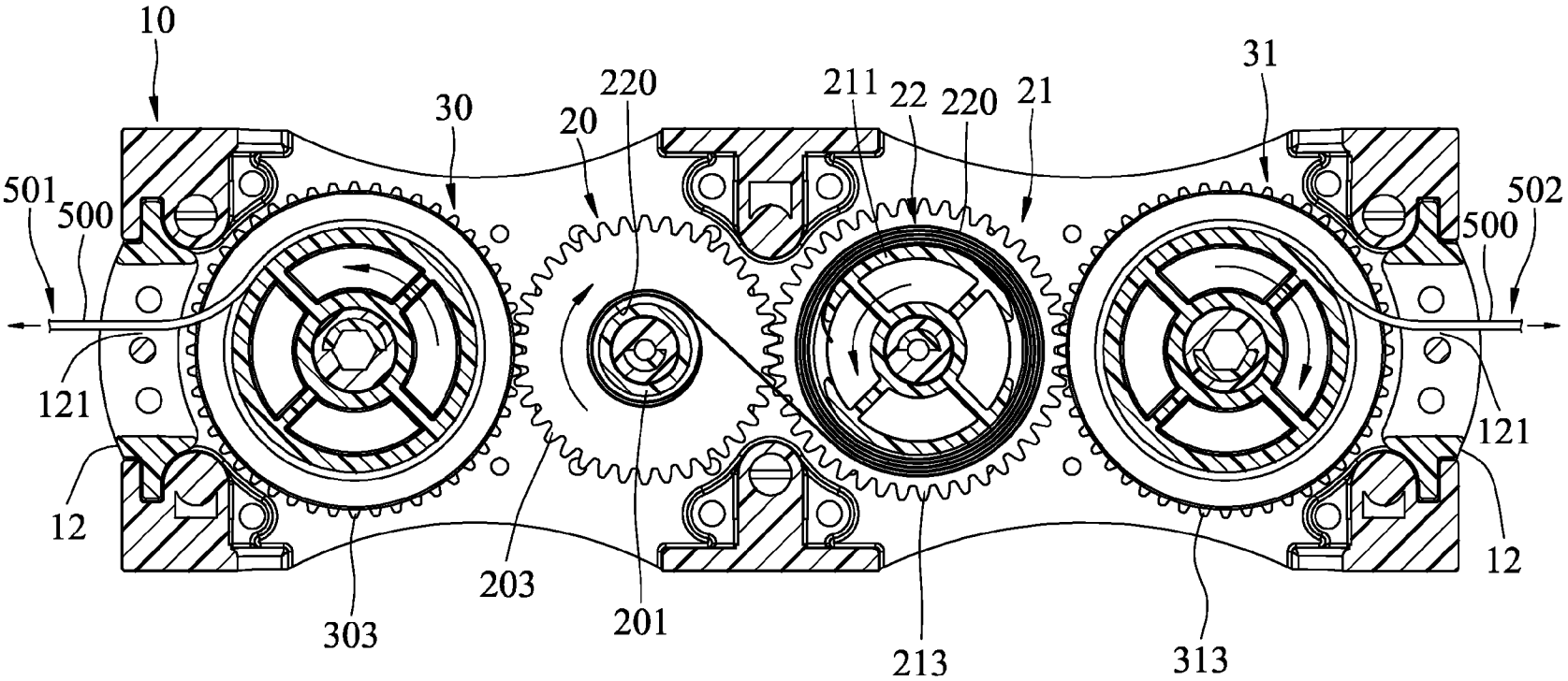
FIG. 13 is a cross-sectional view similar to FIG. 12, but illustrating the main cord segment in a drawn-out position.

When a user pulls the bottomrail 300 downwardly to displace the main cord segment 500 from the drawn-in position (FIG. 12) toward the drawn-out position (FIG. 13) and stops the bottomrail 300 at a desired position, as shown in FIG. 13, the first cord spool 30 and the second control wheel 21 rotate counterclockwise, the second cord spool 31 and the first control wheel 20 rotate clockwise, and the looped end portion 220 rotates relative to the first wheel hub 201 to permit the spring body 221 to be unwound from the first wheel hub 201 and to be wound on the second wheel hub 211. At this point, the spring body 221 acquires the biasing force (but the looped end portion 220 will not acquire a biasing force), and the bottomrail 300 is retained at the desired position by virtue of the frictional engagement among the first wheel teeth 203, the second wheel teeth 213, the first spool teeth 303, and the second wheel teeth 213. When the user pushes the bottomrail 300 upwardly, the biasing force will cause the spring body 221 to wind back on the first wheel hub 201, thereby displacing the main cord segment (500) to the drawn-in position (FIG. 12).

As the window blind of this embodiment does not include a take-up drum, and as the looped end portion 220 of the coil spring 22 is directly sleeved on the first wheel hub 201, the prior art drawback of wearing of the take-up drum caused by friction generated between the take-up drum and a coil spring can be avoided, and the window blind may have a longer service life.

Figure 14:
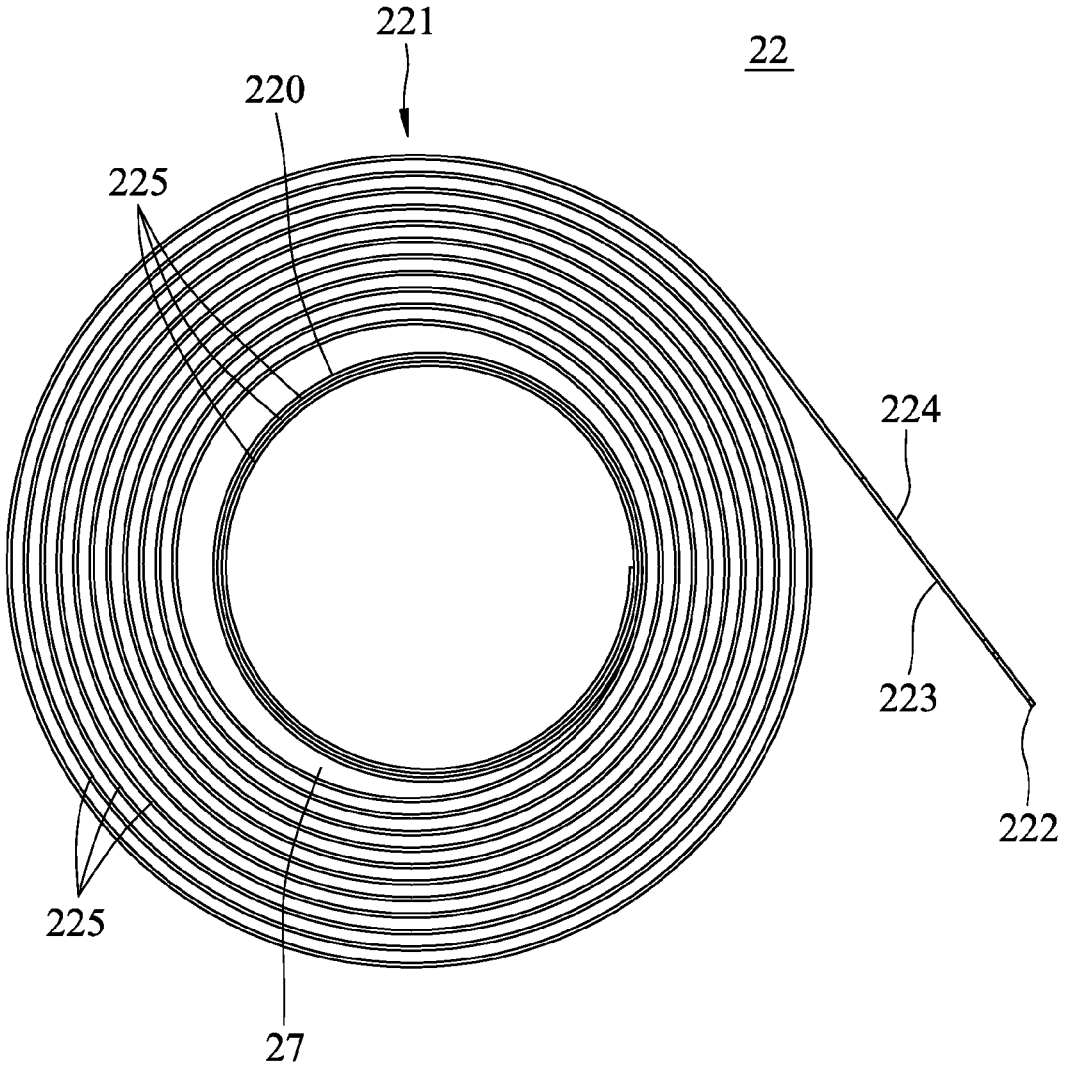
FIG. 14 is a top view of a coil spring used in a window blind device according to a second embodiment of the disclosure.
Figure 15:
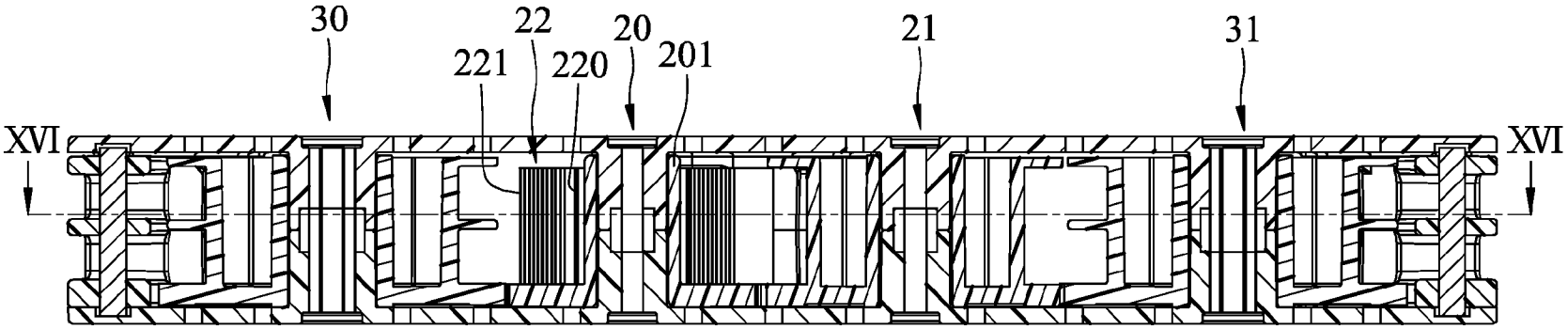
FIG. 15 is a cross-sectional view of a frame of the window blind device according to the second embodiment, in which the coil spring of FIG. 14 is sleeved on a first wheel hub.
Figure 16:
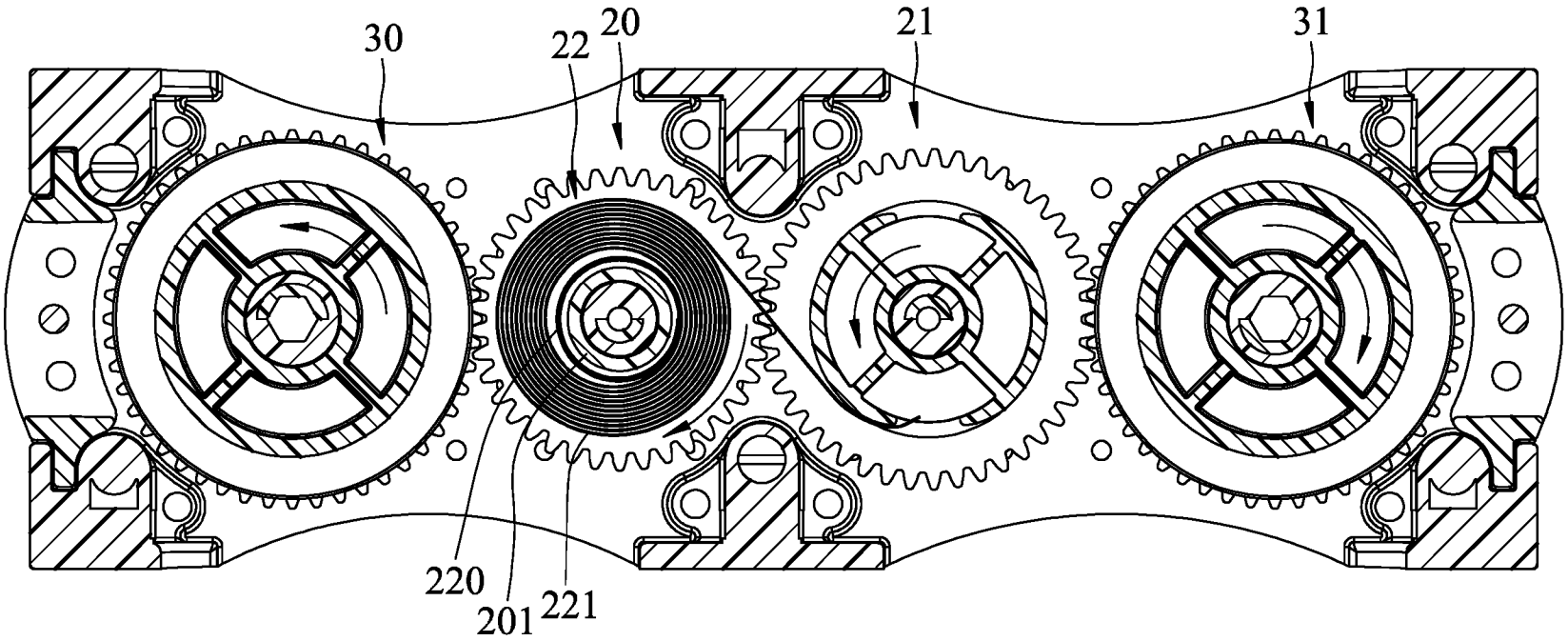
FIG. 16 is a cross-sectional view taken along line XVI-XVI of FIG. 15.

FIGS. 14 to 16 illustrate a window blind device according to a second embodiment of this disclosure. The second embodiment is similar to the first embodiment except that the looped end portion 220 is formed by an innermost pair of the coils 225 in abutting engagement with each other. In FIG. 14, the innermost three coils 225 are in abutting engagement with one another.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A window blind device comprising:

a headrail extending in a longitudinal direction;

a bottomrail which extends in the longitudinal direction to terminate at left and right ends, and which are movable relative to said headrail in an upright direction between an uppermost position and a lowermost position;

a window shade having an upper end connected to said headrail, and a lower end connected to said bottomrail so as to be moved therewith;

a first control wheel including a first wheel hub mounted rotatably on one of said headrail and said bottomrail about a first wheel axis;

a second control wheel including a second wheel hub mounted rotatably on said one of said headrail and said bottomrail about a second wheel axis parallel to the first wheel axis; and a coil spring having a looped end portion sleeved on said first wheel hub, and a spring body wound on said first wheel hub and extending from said looped end portion to terminate at a leading spring end which is connected to said second wheel hub, wherein said first and second control wheels are coupled to the other one of said headrail and said bottomrail, such that in synchrony with displacement of said bottomrail from the uppermost position to the lowermost position, said looped end portion and said first wheel hub are rotated relative to each other, wherein said coil spring is a flat coil spring, and said looped end portion is formed by welding a terminal region onto an innermost coil.

2. The window blind device according to claim 1, wherein:

said first and second control wheels are mounted rotatably on said headrail and are coupled to said bottomrail;

said first control wheel further includes a first wheel rim surrounding the first wheel axis; and said second control wheel further includes a second wheel rim which surrounds the second wheel axis, and which is configured to be in frictional engagement with said first wheel rim so as to permit said first and second control wheels to rotate synchronously.

3. The window blind device according to claim 2, further comprising:

a first cord spool including a first spool hub mounted rotatably on said headrail about a first spool axis parallel to the first wheel axis, and a first spool rim which surrounds the first spool axis, and which is configured to be in frictional engagement with said first wheel rim so as to permit said first cord spool and said first control wheel to rotate synchronously;

a second cord spool including a second spool hub mounted rotatably on said headrail about a second spool axis parallel to the first wheel axis, and a second spool rim which surrounds the second spool axis, and which is configured to be in frictional engagement with said second wheel rim so as to permit said second cord spool and said second control wheel to rotate synchronously; and first and second cords each having a main cord segment which is wound on a corresponding one of said first and second spool hubs, and which extends to terminate at a leading cord end connected to a corresponding one of said left and right ends of said bottomrail, such that, in synchrony with displacement of said bottomrail from the uppermost position to the lowermost position, said main cord segment is moved from a drawn-in position to a drawn-out position to drive said first and second cord spools to rotate.

4. The window blind device according to claim 3, wherein said second wheel hub is configured to be of a larger dimension than said first wheel hub such that, in response to the movement of said main cord segment from the drawn-in position toward the drawn-out position, said looped end portion is rotated relative to said first wheel hub to permit winding of said spring body on said second wheel hub to allow said spring body to acquire a biasing force so as to cause said spring body to wind back on said first wheel hub, thereby displacing said main cord segment to the drawn-in position.

5. The window blind device according to claim 4, wherein:

said first control wheel further includes a plurality of first wheel teeth disposed on said first wheel rim to surround the first wheel axis;

said second control wheel further includes a plurality of second wheel teeth which are disposed on said second wheel rim to surround the second wheel axis, and which are configured to mesh with said first wheel teeth so as to permit said first and second control wheels to rotate synchronously;

said first cord spool further includes a plurality of first spool teeth which are disposed on said first spool rim to surround the first spool axis, and which are configured to mesh with said first wheel teeth so as to permit said first cord spool and said first control wheel to rotate synchronously; and said second cord spool further includes a plurality of second spool teeth which are disposed on said second spool rim to surround the second spool axis, and which are configured to mesh with said second wheel teeth so as to permit said second cord spool and said second control wheel to rotate synchronously.

6. The window blind device according to claim 4, wherein said coil spring is a flat coil spring, and said looped end portion is formed by an innermost pair of coils in abutting engagement with each other.

7. The window blind device according to claim 4, wherein said second wheel hub has an inner sub-hub of a dimension substantially the same as said first wheel hub, an outer sub-hub spaced apart from said inner sub-hub in radial directions, and a plurality of ribs interconnecting said inner sub-hub and said outer sub-hub.

* * * * *